US006669608B1

(12) United States Patent
Winston

(10) Patent No.: US 6,669,608 B1
(45) Date of Patent: Dec. 30, 2003

(54) ADJUSTABLE WEIGHTED VEST

(76) Inventor: Edith Winston, P.O. Box 8288, 2110 Harborside Dr. #528, Longboat Key, FL (US) 34228

( * ) Notice: Subject to any disclaimer, the term of this patent is extended or adjusted under 35 U.S.C. 154(b) by 0 days.

(21) Appl. No.: 09/476,802

(22) Filed: Dec. 30, 1999

(51) Int. Cl.[7] ..... A63B 21/065
(52) U.S. Cl. ..... 482/105; 482/139; 2/102
(58) Field of Search ..... 482/105, 74, 93, 482/139, 148; 2/69, 102, 108, 115; 405/186

(56) References Cited

U.S. PATENT DOCUMENTS

| | | | | | |
|---|---|---|---|---|---|
| 3,334,898 | A | | 8/1967 | McCrory et al. | |
| 4,106,121 | A | | 8/1978 | Belson | |
| 4,268,917 | A | | 5/1981 | Massey | |
| 4,344,620 | A | | 8/1982 | Debski | |
| 4,382,302 | A | * | 5/1983 | Watson | 2/102 |
| 4,394,012 | A | | 7/1983 | Egbert et al. | |
| D278,840 | S | | 5/1985 | Winston | |
| 4,602,387 | A | | 7/1986 | Zakrzewski | |
| 4,658,442 | A | | 4/1987 | Tomlinson et al. | |
| 4,669,127 | A | | 6/1987 | Swanson | |
| 4,838,546 | A | | 6/1989 | Winston | |
| 4,958,386 | A | * | 9/1990 | Louis-Jeune | 2/7 |
| 4,989,267 | A | | 2/1991 | Watson | |
| 5,002,270 | A | | 3/1991 | Shine | |
| 5,010,596 | A | | 4/1991 | Brown et al. | |
| 5,127,891 | A | | 7/1992 | Winston | |
| 5,144,694 | A | | 9/1992 | Conrad Da oud et al. | |
| D340,794 | S | * | 11/1993 | Winston | D2/289 |
| D362,702 | S | | 9/1995 | Winston | |
| 5,553,322 | A | * | 9/1996 | Cebo-Johnson | 2/69 |
| D390,338 | S | | 2/1998 | Plasco | |
| 5,768,706 | A | | 6/1998 | Griffith et al. | |
| 5,810,699 | A | | 9/1998 | Nadeau | |
| 5,978,964 | A | * | 11/1999 | Gaston | 2/69 |
| 6,113,521 | A | * | 9/2000 | Winston | 482/105 |

* cited by examiner

*Primary Examiner*—Nicholas D. Lucchesi
*Assistant Examiner*—Victor Hwang
(74) *Attorney, Agent, or Firm*—Edell, Shapiro & Finnan LLC

(57) ABSTRACT

An exercise vest includes a plurality of weight receiving vest pockets, all disposed on the outer surface of the vest at locations spaced from the wearer's spine, shoulders and upper torso. Weight receiving modules are disposed in respective vest pockets and include individual pouches for receiving the weights. The module and vest each include at least one foam padding layer to provide at least two layers of such padding between the weights and the body of the wearer.

26 Claims, 3 Drawing Sheets

ADJUSTABLE WEIGHTED VEST

BACKGROUND OF THE INVENTION

1. Technical Field

The present invention pertains to weighted apparel for use in exercise and therapeutic applications. Although the preferred embodiment described herein is a weighted vest, it is to be understood that the principles of the invention apply to weighted garments of all types such as belts, pants, jackets, etc.

2. Discussion of the Prior Art

It is known to provide vests with the capability of selectively receiving and supporting plural weights to permit the wearer to exercise and/or rehabilitate various muscles. Examples of such vests maybe found in the following U.S. Patents:

| U.S. Pat. No. | Patentee |
|---|---|
| Des. 278,840 | Winston |
| Des. 340,794 | Winston |
| Des. 390,338 | Plasco |
| 4,268,917 | Massey |
| 4,344,620 | Debski |
| 4,394,012 | Egbert et al. |
| 4,602,387 | Zakrzewski |
| 4,658,442 | Tomlinson et al. |
| 4,989,267 | Watson |
| 5,010,596 | Brown et al. |
| 5,144,694 | Da oud et al. |
| 5,768,706 | Griffith et al. |
| 5,810,699 | Nadeau |

A desirable feature of weighted vests is adjustability of the total weight supported by the vest so that exercise and rehabilitation can be continued as the wearer's muscles are progressively strengthened. It is known, for example, to provide pockets in a vest with one or more compartments of the pocket adapted to receive steel bars or other weighted material. Prior art vests of this type suffer from a number of problems and disadvantages that are addressed by the present invention. For example, designers of these vests have heretofore given little or no consideration to the relationship between the vest construction and potential unintended injury to the wearer. In this regard, weight receiving pockets are often placed adjacent portions of the wearer's body that are vulnerable to injury. Particularly vulnerable are areas of the chest adjacent the heart and lungs, the shoulder plexus area where nerve endings that affect hand motion are close to the skin, the spine area which has no fleshy cushioning to protect the spinal column, etc. In addition, shoulder joints per se must be protected as must the wearer's groin region. Further, even relatively non-vulnerable body parts must be protected against impact as the weights move relative to the wearer's body during exercise routines.

Apart from protecting the wearer, a weighted vest must be comfortable and non-restricting during workouts. The vest must hold the weights securely while permitting weights to be added and removed with relative ease and simplicity.

OBJECTS AND SUMMARY OF THE INVENTION

It is an object of the present invention to provide an adjustably weighted vest constructed to minimize injury to the wearer while facilitating the removal and insertion of weights.

It is another object of the present invention to provide a unique weight-receiving module for attachment in a pocket in an adjustably weighted vest in a manner to substantially eliminate injury to the wearer of the vest during exercise.

Another object of the present invention is to provide an improved method of protecting the wearer of an adjustably weighted vest against injury during use of the vest in exercise routines.

The aforesaid objects maybe achieved individually and in combination, and it is not intended that the present invention be construed as requiring two or more of the objects to be combined unless expressly required by the claims attached hereto.

A vest constructed according to the present invention includes at least one layer of resilient plastic foam sandwiched between and bonded to inner and outer heavy denier fabric layers. A module for receiving a plurality of weights comprises a layer of resilient plastic foam sandwiched between and bonded to two layers of similarly heavy denier fabric material. The material in each case is preferably nylon. The interiorly facing fabric layer of the module is sewn or otherwise secured to the outer fabric layer of the vest inside a vest pocket. A further fabric sheet is sewn or otherwise secured to the exteriorly facing fabric layer of the module in a manner to form a plurality of side-by-side pouches that are open at their tops to receive elongated weight bars. The weight bars are thus separated from the wearer's body by at least two layers of protective foam (i.e., the vest foam layer and the module foam layer). A flap from the vest pocket covers the pocket opening and the opening in the pouches to prevent inadvertent removal of the weights from the pouches.

The weight bars are elongated solid members having a transverse cross section in the form of a slightly truncated circle. The flat truncated surface of the bar faces inwardly toward the foam to distribute any force exerted by the weight over that surface and thereby minimize the pressure against the body of the wearer.

To further protect the wearer, the shoulder region of the vest is provided with two layers of foam padding. Similar double foam layering is provided along the bottom of the vest which is suspended near the wearer's groin.

The vest pockets into which the weight-receiving modules are sewn are all located on the vest exterior at positions away from the wearer's spine area, shoulders and upper torso. The vest interior surface is smooth and substantially uninterrupted fabric (e.g., heavy denier nylon). The vest pocket flaps are secured closed over the pocket weights by Velcro, or the like, to prevent the weights from inadvertently falling out of pockets during exercise. On the other hand, the weights are easily accessible to be selectively removed from or inserted into the module pouches without requiring removal of the vest from the wearer's body.

The sleeve opening in the vest is large so that a single size fits all wearers, and the vest is constructed to be gender non-specific.

The above and still further objects, features and advantages of the present invention will become apparent upon consideration of the following detailed description of specific embodiments thereof, particularly when taken in conjunction with the accompanying drawings wherein like reference numerals and the various figures are utilized to designate like components.

DESCRIPTION OF THE PREFERRED EMBODIMENTS

Figure 2:
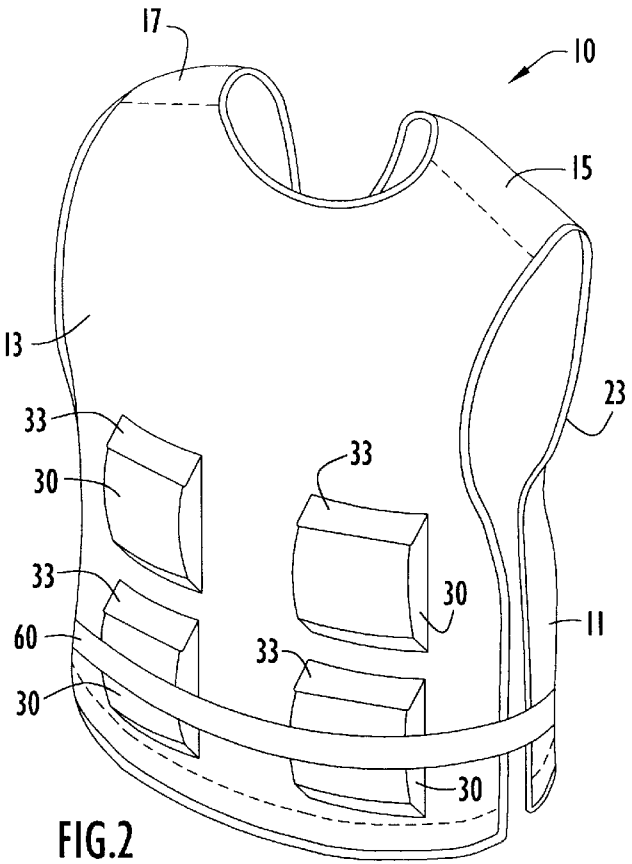
FIG. 2 is a view in perspective from behind of the vest of FIG. 1.
Figure 1:
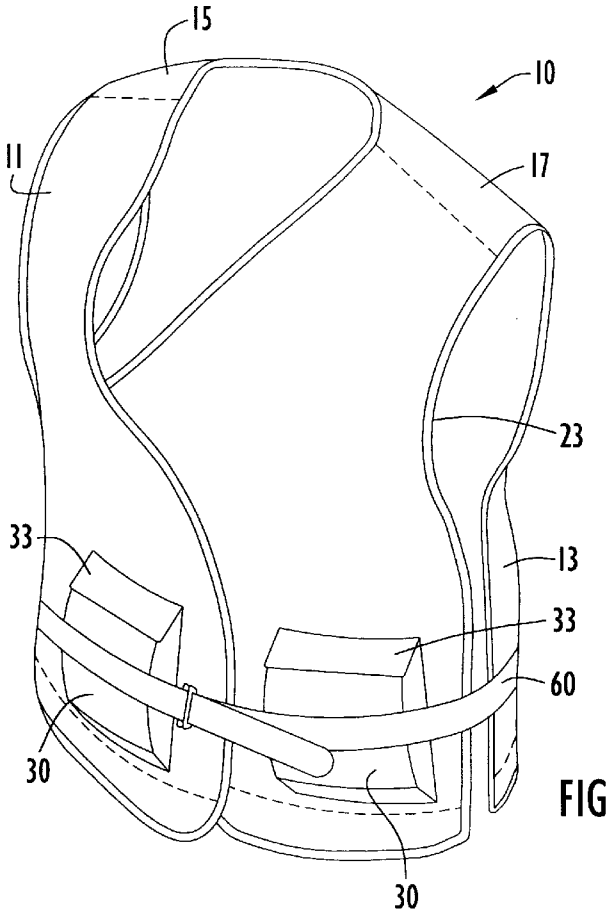
FIG. 1 is a view in perspective from the front of an adjustably weighted vest constructed in accordance with the principles of the present invention.
Figure 4:
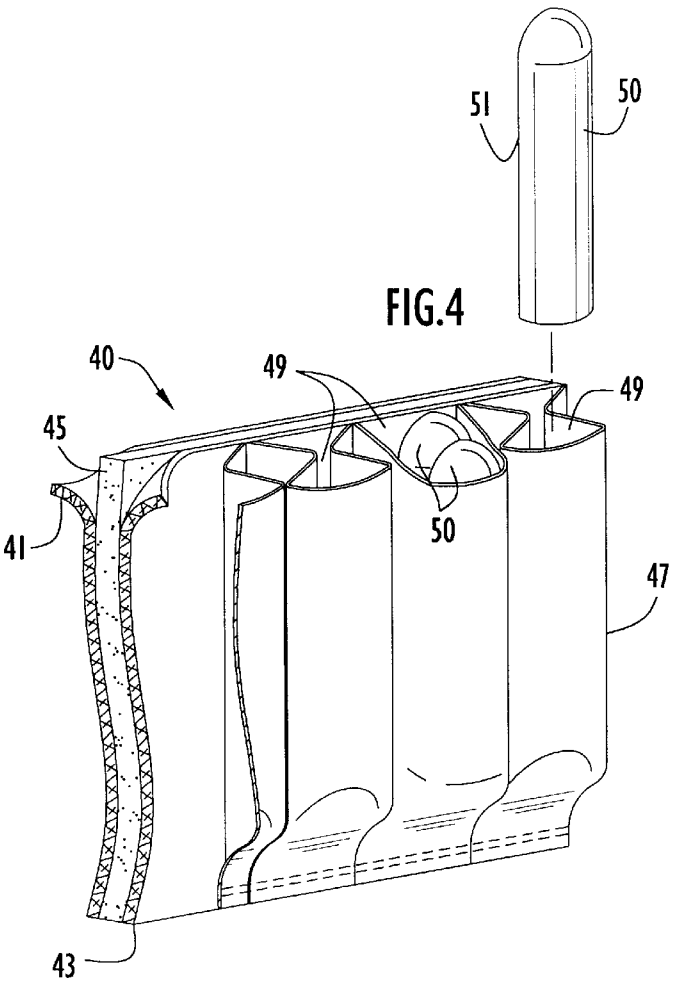
FIG. 4 is an exploded view in perspective of a weight-receiving module constructed in accordance with the principles of the present invention and utilized in the vest of FIG. 1.
Figure 3:
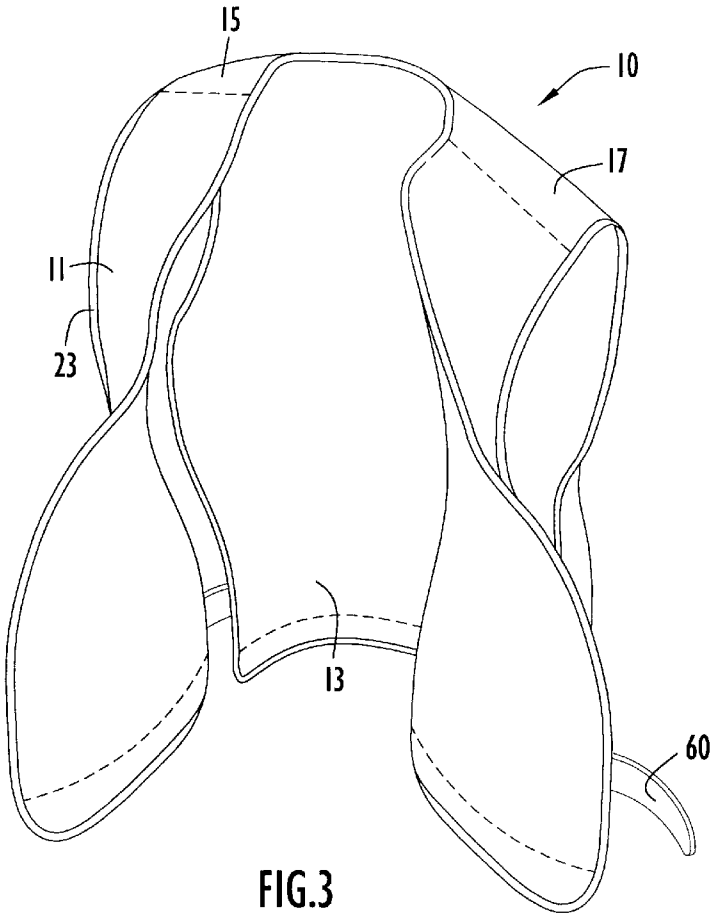
FIG. 3 is a view in perspective of the vest of FIG. 1 shown open so as to permit the interior of the vest to be viewed.
Figure 6:
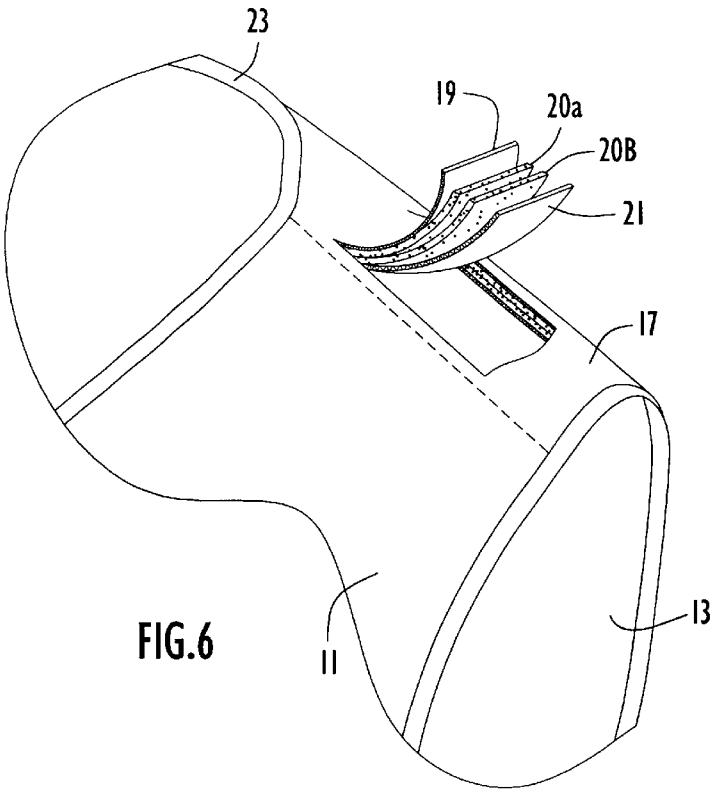
FIG. 6 is a broken view in perspective of the shoulder region of the vest of FIG. 1.
Figure 5:
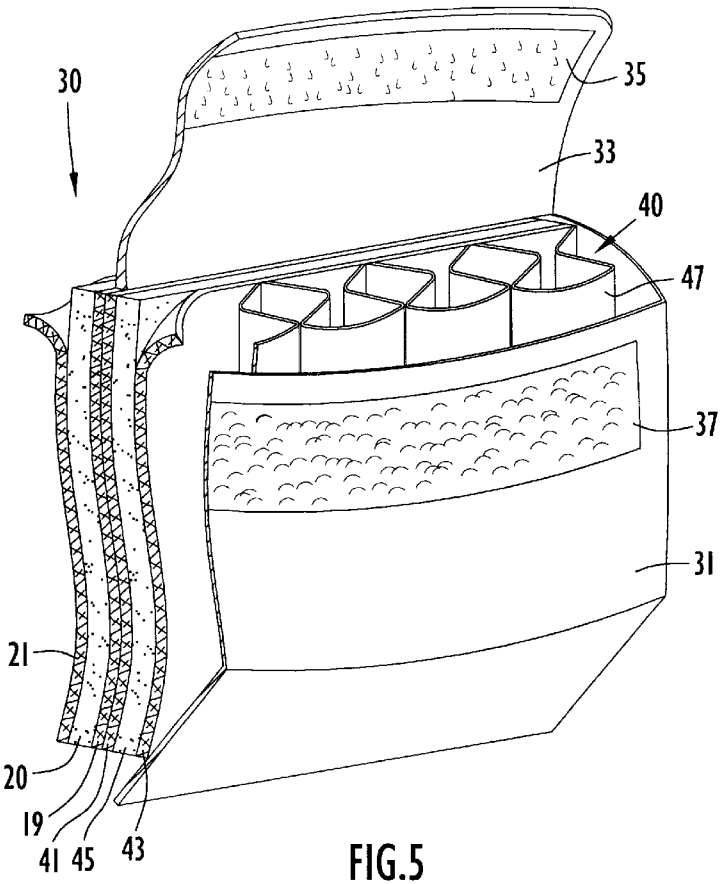
FIG. 5 is a detailed view in perspective and partial section showing the construction of the pocket of the vest of FIG. 1.

Referring to the drawings in greater detail, an adjustably weighted vest 10 includes a front panel 11 and rear panel 13 joined only by shoulder portions 15 and 17. The vest panels and shoulder portions each have a multilayer construction (best illustrated in FIGS. 5 and 6) comprising an outer fabric layer 19 coextensive with an inner fabric layer 21, and a foam padding 20 sandwiched between the inner and outer fabric layers. Preferably, although not necessarily, each of the inner fabric layer 21 and outer fabric layer 19 is made of a single sheet of material. In the preferred embodiment that material is a heavy denier nylon but may be other material that is strong yet pliable and moisture resistant. The foam padding 20 is resilient plastic foam, for example, polyurethane. Throughout most of the vest the foam padding is a single layer of the foam having a thickness on the order one-quarter to one-half inch. However, in the shoulder portions 15, 17 the padding includes two such layers 20*a* and 20*b* of the foam. The bottom portion of each of the panels 11 and 13 also has a double foam layer to protect the groin area of the wearer. The inner and outer fabric layers 19, 21 are secured together at their peripheries by means of a piping 23 sewn to both layers, thereby securing the padding between the layers.

Plural vest pocket layers 30 are formed on the vest at various locations by sewing or otherwise bonding the edges of a sheet 41 of the same fabric material to the outer fabric layer 19 of the vest. Sufficient slack is provided between sheet 41 and outer fabric layer 19 to define the pocket. Only the top edge of the sheet 41 is not secured to outer layer 19 to thereby define a pocket opening. A flap 33 of the same fabric material is secured along one edge to the outer fabric layer 19 and is suspended over the pocket opening. The interior surface of flap 33 and the outer surface of sheet 31 are provided with mating strips 35, 37 of hook and eye material (e.g., Velcro) or other closure arrangement such as snaps, zipper, etc., to permit easy selective closure of the pocket opening.

The pockets 30 are located spaced from the upper torso, shoulders and spine of the wearer to prevent injury to those body regions from weights contained in the pockets. In the illustrated embodiment there are six pockets, four secured in two transversely spaced columns of two pockets to the rear panel 13, and two transversely spaced pockets secured to the front panel 11. All of the rear pockets are positioned so as to be at least three inches below the wearer's shoulder blades and at least three inches laterally of the wearer's spine. The front pockets are all positioned so as to be below the wearer's rib cage.

A weight receiving module 40 is disposed in each pocket and includes an inward sheet 41 and outward sheet 43 of fabric material secured together at their peripheral edges to enclose a layer of foam padding 45 therebetween. The fabric material and foam are preferably the same as the materials is used for the vest. A pouch-forming sheet 47 is sewn or otherwise secured to outward sheet 43 along the periphery of sheet 47 and along transversely spaced vertical lines in order to form a plurality of side-by-side weight-receiving pouches 49. The pouches are formed as collapsible bloused gussets, open at their tops, and suitable for receiving more than one weight bar 50 in each pouch. Similar gusset structure is described in my U.S. Pat. No. 4,838,546, the disclosure of which is incorporated by reference herein.

Inward sheet 41 of each module 40 is sewn or otherwise secured to the outer fabric layer of the vest in a respective vest pocket 30. The module is sized to fit in its associated vest pocket, preferably with little or no extra space other than is necessary to receive at least two weight bars 50 in side-by-side relation in each pouch 49.

Longitudinally extending weight bars 50 are made of steel or other suitable dense material. The length of each bar is such that it fits in a pouch 49 when pocket flap 33 is closed over the pocket opening. Each bar is generally cylindrical but has a flat surface portion 51 extending substantially the length of the bar. It is intended that the flat surface portion of the bar face inwardly (i.e., toward the wearer's body) when the bar is inserted into a pouch 49. In this manner the surface area of the bar that directly faces the wearer's body is expanded to distribute inwardly-directed forces over that expanded area.

A belt 60 is sewn or otherwise secured at various locations on the outer surface of sheet 31 of plural pockets 30 on the front and rear panels of the vest. Belt 60 is provided with a D-ring 61 or other suitable closure mechanism that can be tightened as necessary by the wearer to adjust the manner in which the vest fits the wearer. The front and rear panels 11, 13 are open (i.e., not joined) below the wearer's arms and are pulled together in these regions beneath the arms by closure of belt 60. The front panel of the vest maybe formed with two separated sections as shown, in which case tightening of belt 60 forces an overlap of the adjacent edges of these sections to effect closure. Alternatively, the front panel 11 maybe formed without a front opening, thereby requiring the vest to be donned as a pullover, in which case belt tightening brings the sides of panels together under the wearer's arms. Alternatively, or in addition, a pair of side belts may be used to join the front and rear panels 11, 13 on respective sides of the vest.

Although it is preferable that module 40 be made of the same materials as the vest, different materials may be used if desired. An important feature is the construction of the module whereby at least two layers of foam padding are disposed between weight bars 50 and the wearer's body, namely foam padding 20 of the vest panel and foam padding 45 of module 40.

Another important feature of the invention is the location of the pockets and the weight bars that they carry. No pockets are disposed along the wearer's spine, lungs, heart, shoulder and groin. This positioning of the pockets significantly minimizes the possibility of injury to the wearer of the vest.

Although the weight receiving pouches 49 have been described as being gusseted to permit more than one weight bar 50 to be received therein, it is within the scope of the invention to provide non-gusseted pouches sized to receive only a single weight bar.

The inner fabric layer 21 of the vest is without vest pockets and devoid of any other irregularity of structure that would interrupt the smooth surface of the fabric. This feature, too, minimizes both injury and discomfort to the wearer.

Although module 40 has been shown and described as being sewn into vest pocket 30, it is also possible to removably secure the module in the pocket (e.g., by snaps, Velcro, zipper, etc.). Selective removal of the module may be desirable for purposes of replacement, cleaning, etc.

The base of pocket 30 maybe reinforced with a double layer of material, or the like, to prevent the bottom edge of the pocket from tearing away from the vest panel under the force exerted by weight bars 50. This may be particularly necessary if the module 40 is removable from pocket 30.

Belt 60 or other closure mechanism can be vertically located anywhere on the vest from the wearer's breast bone down. Although D-ring closures are preferable, locking buckles, Velcro or other fastening mechanisms maybe utilized. As a further possibility, side belts may be utilized to join vertical edges of the panels 11, 13 at the sides of the vest.

The front and rear vest panels may be joined along the vest sides by material, if desired. Preferably, such material should be pleated or elastic to permit the vest to expand widthwise and contract to fit wearers of all sizes. The side edges of the panels maybe joined by zippers or snap connections.

The length of the vest may also be made adjustable by providing additional material that can be selectively folded along transverse fold lines, stitched, snapped or secured by Velcro, to selectively shorten and lengthen the vest as desired.

The pocket 30 maybe made of elasticized, stretchable material to facilitate accommodation of different numbers of weight bars therein and to further maintain the weight bars away from the wearer's body. In addition, stretch material maybe used for sheet 47 so that pouches 49 maybe stretched upon receiving the weight bars and then contract to further retain the weight bars in the pouches.

The use of two layers of padding between the weights and wearer's body is also applicable to exercise belts and other garments that are adjustably weighted according to the present invention.

Although in the preferred embodiment of the invention module 40 is located inside a pocket 30 of vest 10, it is within the scope of the invention that module 40 maybe secured to outer fabric 19 of the vest without any surrounding vest pocket. The important point here is that the padding layer 20 of the vest and the padding layer 45 of the module are interposed between the body of the wearer and each pouch 49 so that the weight bars 50 are spaced by two padding layers from the wearer's body. If the module is not disposed in a pocket, a separate flap for the module must be provided or the module must be provided with elasticized pouches to assure that the weight bars remain in the pouches during exercise.

From the foregoing description it will be appreciated that the present invention makes available a novel adjustable weighted garment providing increased protection of the wearer against injury from weights while permitting weights to be selectively added and removed without removing the garment from the wearer's body. The garment maybe economically manufactured in a "one size fits all", gender non-specific form.

Having described preferred embodiments of a new and improved adjustable weighted vest in, accordance with the present invention, it is believed that other modifications, variations and changes will be suggested to persons skilled in the art in view of the teachings set forth herein. It is therefore to be understood that all such variation, modifications and changes are believed to fall within the scope of the present invention as defined by the appended claims.

What is claimed is:

1. An adjustably weighted vest adapted to be worn over the upper abdomen of a person to cover at least the person's shoulders, spine and rib cage, said vest comprising:

a front panel and a rear panel each comprising an outer fabric layer, an inner fabric layer, a first foam padding sandwiched between the inner and outer fabric layers, and means securing said front and rear panels to one another to form a vest;

a plurality of weight-receiving modules each including an interior fabric layer, an exterior fabric layer and a second foam padding sandwiched between said interior and exterior layers, each module including at least one pouch secured to the exterior fabric layer of said each module for receiving a weighted bar; and means securing said modules to said front and rear panels such that the second foam padding layer of each module is separated from the first foam padding layer of the vest by said outer fabric layer and said interior fabric layer.

2. The adjustably weighted vest of claim 1 further comprising a plurality of weighted bars sized to fit in a respective pouch of said modules.

3. The adjustably weighted vest of claim 2 wherein each of said weighted bars has a generally cylindrical configuration with one flat elongated side adapted to face inward toward the person's abdomen when disposed in a pouch.

4. The adjustably weighted vest of claim 1 wherein said modules are disposed only at predetermined locations on said vest, each predetermined location being spaced from the person's spine and shoulders when the vest is being worn.

5. The adjustably weighted vest of claim 4 wherein the spacing of each predetermined location from the person's shoulders and spine is at least three inches.

6. The adjustably weighted vest of claim 4 further comprising a plurality of vest pockets disposed on said outer fabric layer of said vest at respective ones of said predetermined locations, wherein each of said modules is disposed in a respective vest pocket.

7. The adjustably weighted vest of claim 1 further comprising a plurality of vest pockets disposed on said outer fabric layer of said vest, wherein each of said modules is disposed in a respective vest pocket.

8. The adjustably weighted vest of claim 7 wherein said modules are removably attached in said pockets by means of snaps, zippers, or hook and eye fasteners.

9. The adjustably weighted vest of claim 7 wherein each pocket is provided with a flap to prevent inadvertent displacement of the weighed bars from the pocket.

10. The adjustably weighted vest of claim 1 wherein portions of said vest disposed over the shoulders of said person when in use include an additional foam padding adjacent said first foam padding between said inner and outer fabric layers of said vest.

11. The adjustably weighted vest of claim 1 wherein portions of said vest disposed over the groin of said person when in use include an additional foam padding adjacent said first foam padding between said inner and outer fabric layers of said vest.

12. The adjustably weighted vest of claim 1 further comprising a plurality of weighted bars, and wherein each module includes a plurality of pouches secured to the exterior fabric layer of said each module for receiving respective weighted bars, whereby each module is capable of selectively receiving carrying in its pouches a plurality of said weighted bars.

13. An adjustably weighted vest adapted to be worn over the upper abdomen of a person to cover at least the person's shoulders, spine and rib cage, said vest comprising:

a front panel and a rear panel each comprising an outer fabric layer, an inner fabric layer, a first foam padding sandwiched between the inner and outer fabric layers, and means securing said front and rear panels to one another to form a vest;

a plurality weight-receiving modules each including an interior fabric layer, an exterior fabric layer and a second foam padding sandwiched between said interior and exterior layers at least one pouch secured to the exterior fabric layer of said each module for receiving a weighted bar; and means securing all of said modules to said front and rear panels only at predetermined locations on said vest that are spaced from the person's spine and shoulders such that no weight receiving modules are disposed in registry with the person's spine and no weight receiving modules are disposed in registry with the person's shoulders when the vest is being worn.

14. The weighted vest of claim 13 further comprising a plurality of weighted bars sized to fit in a respective pouch of said modules, wherein each of said weighted bars has a generally cylindrical configuration with one flat elongated side adapted to face inward toward the person's abdomen when disposed in a pouch.

15. The adjustably weighted vest of claim 13 wherein the spacing of each predetermined location from the person's shoulders and spine is at least three inches.

16. The adjustably weighted vest of claim 13 further comprising a plurality of vest pockets disposed on said outer fabric layer of said vest at respective ones of said predetermined locations, wherein each of said modules is disposed in a respective vest pocket.

17. The adjustably weighted vest of claim 13 further comprising a plurality of vest pockets disposed on said outer fabric layer of said vest, wherein each of said modules is disposed in a respective vest pocket.

18. The adjustably weighted vest of claim 17 wherein said modules are removably attached in said pockets by means of snaps, zippers, or hook and eye fasteners, and wherein each pocket is provided with a flap to prevent inadvertent displacement of the weighed bars from the pocket.

19. The adjustably weighted vest of claim 17 wherein said inner fabric layer has an inward facing surface adapted to be positioned adjacent the person's abdomen, wherein all of said vest pockets are disposed on said outer fabric layer of said vest, and wherein said inner surface is devoid of any pockets and surface irregularities to thereby assure comfort and safety to the wearer.

20. The adjustably weighted vest of claim 13 wherein portions of said vest disposed over the shoulders of said person include an additional foam padding adjacent said first foam padding between said inner and outer fabric layers of said vest.

21. A method of fabricating an adjustably weighted exercise vest comprising the steps of:

(a). forming each of a front panel and rear panel by sandwiching an inner fabric layer between inner and outer fabric layers, and securing said front and rear panels to one another to form a vest;

(b). forming each of a plurality of weight-receiving modules by sandwiching a second foam padding between interior fabric layer and an exterior fabric, and forming in each module at least one weighted bar-receiving pouch by securing a fabric sheet to the exterior fabric layer of said each module; and (c). securing said modules to said front and rear panels such that the second foam padding layer of each module is separated from the first foam padding layer of the vest by said outer fabric layer and said interior fabric layer.

22. The method of claim 21 wherein step (c) includes disposing said modules only at predetermined locations on said vest, each predetermined location being spaced from the person's spine and shoulders.

23. The method of claim 22 further comprising the step of forming a plurality of vest pockets on said outer fabric layer of said vest at respective ones of said predetermined locations, wherein each of said modules is disposed in a respective vest pocket.

24. The method of claim 21 further comprising the step of disposing in the shoulder portions of said vest an additional foam padding adjacent said first foam padding and between said inner and outer fabric layers of said vest.

25. A method of fabricating an adjustably weighted exercise vest comprising the steps of:

(a). forming each of a front panel and rear panel by sandwiching an inner fabric layer between inner and outer fabric layers, and securing said front and rear panels to one another to form a vest;

(b). forming each of a plurality of weight-receiving modules by sandwiching a second foam padding between interior fabric layer and an exterior fabric, and forming in each module at least one weighted bar-receiving pouch by securing a fabric sheet to the exterior fabric layer of said each module; and (c). securing said modules to said front and rear panels only at predetermined locations on said vest that are spaced from the person's spine and shoulders when the vest is being worn.

26. The method of claim 25 wherein step (c) includes securing said modules such that said predetermined locations are at least three inches from the person's shoulders and spine when the vest is being worn.

* * * * *